US005164016A

United States Patent [19]

Henriet et al.

[11] Patent Number: 5,164,016

[45] Date of Patent: Nov. 17, 1992

[54] METHOD FOR PICKLING OR CLEANING MATERIALS OF STEEL, IN PARTICULAR STAINLESS STEEL

[75] Inventors: Dominique Henriet, Chambourcy; Paul Didier, Gueugnon, both of France

[73] Assignee: Ugine, Aciers de Chatillon et Gueugnon, Puteaux, France

[21] Appl. No.: 649,839

[22] Filed: Feb. 5, 1991

[30] Foreign Application Priority Data

Feb. 8, 1990 [FR] France ..... 90 01481

[51] Int. Cl.[5] ..... C23G 1/08

[52] U.S. Cl. ..... 134/2; 134/3; 134/41; 252/79.4

[58] Field of Search ..... 134/2, 3, 41; 156/664; 252/79.4

[56] References Cited

U.S. PATENT DOCUMENTS

| | | | |
|---|---|---|---|
| 3,873,362 | 3/1975 | Mihram et al. | 134/3 |
| 4,389,254 | 6/1983 | Tusset et al. | 134/41 |
| 4,636,368 | 1/1987 | Pralus | 252/79.4 |

*Primary Examiner*—Theodore Morris
*Assistant Examiner*—Saeed Chaudhry
*Attorney, Agent, or Firm*—Cushman, Darby & Cushman

[57] ABSTRACT

Method for pickling or cleaning materials of steel, in particular stainless steel, comprising treating the materials with an aqueous solution containing ferrous ions and ferric ions and an organic acid which does not oxidize the iron in an amount sufficient to maintain the $Fe^{2+}$ and $Fe^{3+}$ ions in solution, the ferric and ferrous ions being present in the solution in a ration $Fe^{2+}/Fe^{3+}$ between 10/90 and 40/60, and maintaining the ration $Fe^{2+}/Fe^{3+}$ within the defined range by addition of hydrogen peroxide.

18 Claims, No Drawings

METHOD FOR PICKLING OR CLEANING MATERIALS OF STEEL, IN PARTICULAR STAINLESS STEEL

The invention relates to a method for pickling or cleaning materials of steel, in particular stainless steel. The pickling method may be employed on materials of steel, in particular stainless steel, in the industrial field before leaving the factory, for example for descaling, but also by non-professionals of metallurgy for cleaning elements of stainless steel.

According to a known method, for stainless steels, the pickling operation comprises dipping the materials into pickling baths composed of nitric acid and hydrofluoric acid in a proportion of 6 to 16% $HNO_3$ per liter and 1 to 5% HF per liter, the temperature at which the baths are used being in a range of 40° C. to 60° C.

However, the nitric acid results in a release of oxide vapours or nitrogen dioxide which are particularly toxic, and the release of nitro-compounds such as nitrites and nitrates in the effluents. While the maximum allowed content of nitrates is relatively high, that relating to nitrites is very much lower, since the nitrites result in the formation of harmful nitrosamines.

The document FR-A-2 587 369 describes a method for pickling materials of stainless steel in which there is employed a pickling bath composed of hydrofluoric acid, dissolved ferric iron, the balance being water. The bath is employed at a temperature of 15° C. to 70° C. During the pickling operation or operations, the ferric iron content of the bath is maintained by injecting air or by circulation in the open air.

Such a method based on hydrofluoric acid has the drawback that, as hydrofluoric acid may be dangerous to handle, it cannot be suitable for all the cleaning operations employing a spraying or sprinkling of metal elements such as for example a vat or tank.

There is also known from the document JP-A-7547826 a method for pickling materials of stainless steel consisting in the use of a bath composed of a mixture of halogenated acids containing a given proportion of hydrochloric acid.

In this pickling method, the principal agent involved in the chemical reaction is the hydrochloric acid which reacts with the material to be pickled and gives a ferrous chloride with release of hydrogen in accordance with the reaction:

$$2\,HCl + Fe \rightarrow FeCl_2 + H_2$$

Such a method employing the oxidizing action of the hydrochloric acid on the metal to be pickled results in:

a large consumption of hydrochloric acid, which renders the method costly;

a large release of hydrogen which creates risks of explosion when employing the product in a closed environment;

rendering the treated steel fragile by the interstitial diffusion of hydrogen atoms in the crystalline network of the steel.

An object of the invention is to provide a non-polluting method which may be used in the metallurgical industry and also by non-professionals of metallurgy.

The inventors of the present invention have discovered that the pickling of materials of steel, in particular stainless steel, may be carried out, with no need to employ an oxidizing corrosive acid such as HF or HCl, by oxidation by means of a mixture $Fe^{2+}/Fe^{3+}$ whose oxido-reduction potential is maintained between given values, the $Fe^{2+}$ and $Fe^{3+}$ ions being maintained in an aqueous solution by an organic acid which constitutes no danger to man when employed.

The invention therefore provides a method for pickling or cleaning materials of steel, in particular stainless steel, characterized in that the materials are treated by an aqueous solution containing ferrous ions and ferric ions and an organic acid which does not oxidize the iron in sufficient amount to maintain the $Fe^{2+}$ and $Fe^{3+}$ ions in solution, the ferrous and ferric ions being present in the solution in a ratio $Fe^{2+}/Fe^{3+}$ between 10/90 and 40/60, and the ratio $Fe^{2+}/Fe^{3+}$ is maintained within the defined range by addition of hydrogen peroxide.

The acid of the solution, by a secondary reaction during the pickling will give either salts which are easily recyclable in an industrial environment or non-toxic salts so that the method may be employed easily and without danger.

The organic acid is preferably a compound represented by the general formula $$R(COOH)_n$$

in which R represents a H a $C_1$–$C_4$ alkyl group, and a $C_1$–$C_4$ hydroxyalkyl group, or a $C_6$–$C_{14}$ aryl, a $C_6$–$C_{14}$ aralkyl or a $C_6$–$C_{14}$ alkaryl group, optionally substituted by one or more substituents selected from $C_1$–$C_4$ alkyl groups and halogen atoms, and n represents 1, 2 or 3.

Among the preferred organic acids may be mentioned formic, acetic, propionic, butanoic, lactic, benzoic, phthalic, and naphthoic acid.

Advantageously, the ratio $Fe^{2+}/Fe^{3+}$ is between 10/90 and 40/60, preferably between 10/90 and 25/75, and still better about 20/80.

The ratio and therefore the kinetics of the reaction are maintained by regenerating the $Fe^{3+}$ ion by the addition of hydrogen peroxide.

In order to generate the hydrogen peroxide in the pickling bath, it is introduced in the bath or there is added a compound chosen from a peracid, a persalt or an organic peroxide.

The peracid is advantageously chosen from among the perboric, peracetic, percarbonic, perbenzoic, persulfuric, perphosphoric, periodic and perphthalic acids.

The persalt is advantageously chosen from sodium percarbonate and magnesium perborate and the organic peroxide is preferably urea peroxide.

The method is advantageously carried out at a temperature of between 10° and 90° C.

The invention also provides a pickling product for materials of steel, in particular stainless steel, characterized in that it comprises, on one hand, a solution containing ferrous ions and ferric ions, the ratio $Fe^{2+}/Fe^{3+}$ being between 10/90 and 40/60 and a sufficient amount of an organic acid which does not oxidize the iron to maintain the $Fe^{2+}$ and $Fe^{3+}$ ions in solution, and, on the other hand, a source of hydrogen peroxide adapted to be added to the solution to maintain the ratio $Fe^{2+}/Fe^{3+}$ within the defined range.

The organic acid and the source of hydrogen peroxide are such as previously defined.

The pickling and cleaning product may be transported with no particular packaging required to the site of utilization and may be employed anywhere with no particular precautions including for the pickling of closed containers such as tanks, fixed or moving vats or containers.

The method according to the invention may be employed for pickling materials of steel, in particular stainless steel, and in particular for descaling, brightening and cleaning said materials, it being possible to carry out the treatment in a bath, by sprinkling or spraying.

The interest of organic acids is that they decompose into $CO_2$, $H_2O$, and $H_2$, which are decomposition residues which have no harmful effect on the ecological environment when they are rejected into the atmosphere, in the effluents or even at sea.

Another interest is that the organic medium permits forms a passive film which reduces the corrosion of the metal.

Further, the pickling solution employed in the invention avoids the redeposition of certain metals such as Cu, Ni, Cr, Sn, Zn in the course of the pickling, as a result of the high value of the oxido-reduction potential of the solution. On the industrial level, the formation of the $Fe^{3+}$ ion is controlled by the measurement of the oxido-reduction potential of the pickling bath. The oxido-reduction potential or REDOX is the difference in potential measured between a non-corrodable electrode (for example of platinum) and a reference electrode (for example Hg/HgCl or saturated calomel), these two electrodes being immersed in the pickling solution. The measured value permits, on one hand, characterizing the oxidizing power of the pickling bath and, on the other hand, readjusting the bath by introduction of $H_2O_2$ or of the compound capable of supplying $H_2O_2$.

In a preferred manner of carrying out the method of the invention, the source of $H_2O_2$ introduced in the basic pickling solution may be peracid which is the homologue of the acid of the solution, which has for advantage that it does not modify the initial composition of the solution. For example, organic acids/peracids couples which may be used for carrying out the method may be the following: acetic acid/peracetic acid, benzoic acid/perbenzoic acid, phthalic acid/-perphthalic acid.

Another way of not modifying the composition of the basic solution is to employ as a source of $H_2O_2$ an organic oxidizing agent such as percarbonic acid ($H_4(CO_3)_2$, $3H_2O_2$) or again urea peroxide ($CO(NH_2)_2$, $H_2O_2$) which decomposes into $CO_2$, $H_2O$ and $N_2$.

An important advantage of the method employing an organic acid solution is that there is directly obtained ferric oxide ($Fe_2O_3$), a residue which is of use in the electrotechnical field for preparing ferrites.

The advantages of the method reside also in the fact that the oxidizer is created in situ without addition of toxic or polluting substances and without the effluents and waste acid solutions being a danger to man. Further, the product according to the invention comprising the acid solution and its liquid or solid oxidizer may be employed in any environment and even in a confined environment.

The pickling method according to the invention therefore combines the following advantages:

it is non-polluting and without danger when employed;

it permits the use of an acid solution without a marked chemical modification when used, and it allows the recovery and the recycling of the waste products in an industrial environment.

What is claimed is:

1. Method for pickling or cleaning materials of steel comprising the steps of:

applying an aqueous solution to said materials, said aqueous solution containing ferrous ions, ferric ions and an organic acid, said organic acid being present in said aqueous solution in an amount which does not oxidize the iron and which is sufficient to maintain the $Fe^{2+}$ and $Fe^{3+}$ ions in solution, said ferrous and ferric ions being present in said aqueous solution in a ratio $Fe^{2+}/Fe^{3+}$ within a range of between 10/90 and 40/60; and adding during pickling or cleaning hydrogen peroxide to said aqueous solution to maintain said ratio $Fe^{2+}/Fe^{3+}$ within said range, thereby pickling or cleaning said materials.

2. Method according to claim 1, wherein, said organic acid is selected from compounds of formula $$R—(COOH)_n$$

in which R is selected from the group consisting of a $C_1$–$C_4$ alkyl radical, a $C_1$–$C_4$ hydroxyalkyl radical, a $C_6$–$C_{14}$ aryl radical, a $C_6$–$C_{14}$ aralkyl radical and a $C_6$–$C_{14}$ alkaryl radical, optionally substituted by a substituent selected from the group consisting of a $C_1$–$C_4$ alkyl radical and a halogen atom, and n represents 1, 2 or 3.

3. Method according to claim 2, wherein said organic acid is selected from the group consisting of formic, acetic, propionic, butanoic, lactic, benzoic, phthalic, and naphthoic acid.

4. Method according to claim 1, wherein said ratio $Fe^{2+}/Fe^{3+}$ is maintained between 10/90 and 25/75.

5. Method according to claim 4, wherein said ratio $Fe^{2+}/Fe^{3+}$ is maintained at 20/80.

6. Method according to claim 5, wherein said hydrogen peroxide is obtained from a compound selected from the group consisting of a peracid, a persalt and an organic peroxide.

7. Method according to claim 6, wherein said peracid is selected from the group consisting of perboric, peracetic, percarbonic, perbenzoic, persulfuric, perphosphoric, periodic and perphthalic acid.

8. Method according to claim 7, wherein said peracid is the peracid which is the homologue of said organic acid in said solution.

9. Method according to claim 6, wherein the persalt is selected from the group consisting of sodium percarbonate and magnesium perborate.

10. Method according to claim 6, wherein said organic peroxide is urea peroxide.

11. Method according to claim 1, carried out at a temperature between 10° and 90° C.

12. Method according to claim 1, wherein said materials of steel are stainless steels.

13. A solution for pickling or cleaning materials of steel comprising:

an aqueous solution containing ferrous ions and ferric ions, the ratio $Fe^{2+}/Fe^{3+}$ being within a range of between 10/90 and 40/60;

an organic acid dissolved in said solution, said organic acid being present in a quantity which does not oxidize the iron and which is sufficient to maintain said $Fe^{2+}$ and $Fe^{3+}$ ions in said solution; and a source of hydrogen peroxide for addition of said hydrogen peroxide to said solution to maintain said ratio $Fe^{2+}/Fe^{3+}$ within said range during a pickling or cleaning process.

14. A solution according to claim 13, wherein said organic acid is selected from compounds of formula $$R—(COOH)_n$$

wherein R is selected from the group consisting of a $C_1$–$C_4$ alkyl radical, a $C_1$–$C_4$ hydroxyalkyl radical, a $C_6$–$C_{14}$ aryl radical, a $C_6$–$C_{14}$ aralkyl radical and a $C_6$–$C_{14}$ alkaryl radical, optionally substituted by a substitute selected from the group consisting of a $C_1$–$C_4$ alkyl radical and a halogen atom, and n represents 1, 2 or 3.

15. A solution according to claim 14, wherein said organic acid is selected from the group consisting of formic, acetic, propionic, butanoic, lactic, benzoic, phthalic and naphthoic acid.

16. A solution according to claim 13, wherein said source of hydrogen peroxide is selected from the group consisting of a peracid, a persalt and an organic peroxide.

17. A solution according to claim 16, wherein said source of hydrogen peroxide is selected from the group consisting of perboric, peracetic, perbenzoic, persulfuric, perphosphoric, periodic and perphthalic acid, sodium percarbonate, magnesium perborate and urea peroxide.

18. A solution according to claim 12, wherein said materials of steel are stainless steels.

* * * * *